US005088388A

United States Patent [19]

Schaefer

[11] Patent Number: 5,088,388

[45] Date of Patent: Feb. 18, 1992

[54] FRESH-AIR INTAKE WITH ADJUSTABLE AIR DEFLECTORS

[76] Inventor: Ronald E. Schaefer, 5818 Michael Ct., St. Cloud, Minn. 56301

[21] Appl. No.: 737,814

[22] Filed: Jul. 29, 1991

Related U.S. Application Data

[63] Continuation of Ser. No. 508,591, Apr. 13, 1990, abandoned.

[51] Int. Cl.[5] ..... F24F 13/08

[52] U.S. Cl. ..... 454/271; 454/270; 454/304

[58] Field of Search ..... 98/40.17, 37, 40.18, 98/118, 119

[56] References Cited

U.S. PATENT DOCUMENTS

| | | | |
|---|---|---|---|
| 518,984 | 5/1894 | Zimmerman | 98/37 |
| 983,179 | 1/1911 | Swift | 98/37 |
| 1,447,776 | 3/1923 | Friedman et al. | 98/37 |
| 1,532,505 | 4/1925 | Lyon | 98/37 |
| 2,565,122 | 8/1951 | Cowan | 98/37 |
| 3,138,086 | 6/1964 | Rigterink et al. | 98/37 |
| 3,299,798 | 1/1967 | Nabben | 98/37 |
| 4,686,890 | 8/1987 | Stouffer et al. | 98/40.18 |
| 4,794,852 | 1/1989 | Ee | 98/37 |
| 4,850,265 | 7/1989 | Raisanen | 98/37 |

FOREIGN PATENT DOCUMENTS

| | | | |
|---|---|---|---|
| 0005084 | 6/1905 | France | 98/37 |
| 2308873 | 11/1976 | France | 98/40.17 |
| 1514459 | 6/1978 | United Kingdom | 98/40.17 |

OTHER PUBLICATIONS

AAA Associates Inc. brochure for Adjust-A-Baffle.
AAA Associates Inc. brochure for Vari-Vent Air Controller.
Vent-O-Matic brochure: Air-Balancer Air Inlet System.
Prudent Airstream brochure: Automatic Ceiling Inlet Prudent Products, Inc.
Prudent Airstream brochure: Automatic Wall Inlet Prudent Products, Inc.
Agri-Aide Ventilation brochure: Valve Controlled Air-Intakes.
Del-Air Systems brochure: The Del-Air C-Series Center Air Inlet (Del-Air Americas Ltd.).
Schaefer Fan Co. brochure: Barn Kooler System.
Schaefer Fan Co. brochure: Flush-Mount Exhaust Fans.
Schaefer Fan Co. brochure: Panel-Style Exhaust Fans.

*Primary Examiner*—Albert J. Makay
*Assistant Examiner*—William C. Doerrler
*Attorney, Agent, or Firm*—Palmatier & Sjoquist

[57] ABSTRACT

An all season, adjustable fresh air intake for agricultural buildings is claimed which is adapted to adjust the volume, velocity and direction of fresh air drawn from the outside, through the intake and into the building suitably by exhaust fans. The intake is firstly comprised of a hollow building body. The body extends from outside the building, through a ceiling or wall of the building with an opening extending into the building for bringing fresh air into the building from the outside. An air intake housing with at least one opening is attachable to the building body on the inside of the building at the body opening through which fresh air from outside may flow. A pair of independently adjustable deflectors are pivotally mounted onto the housing adjacent the opening in opposing relationship to each other to manually open and close the opening as well as direct the fresh air from ceiling to floor as the fresh air is drawn into the building through the fresh air intake.

19 Claims, 5 Drawing Sheets

FRESH-AIR INTAKE WITH ADJUSTABLE AIR DEFLECTORS

This is a continuation of co-pending application Ser. No. 508,591 filed on Apr. 13, 1990 now abandoned.

BACKGROUND OF THE INVENTION

This invention relates to an all season, adjustable fresh air intake for agricultural buildings. The intake is adapted to adjust the volume, velocity and direction of fresh air drawn from the outside, through the intake and into a building typically by action of an exhaust fan.

It is well known that seasonal problems occur in controlling the atmosphere within poultry, dairy, hog, calf and horse barns or buildings. The air within such buildings becomes stagnant and ridden with ammonia and moisture—all detrimental to the health and production of poultry and animals. In the summer it is necessary to cool the buildings to prevent heat stress, to control flies and flying insects and to maintain production levels of animals otherwise exposed to high temperatures. In the winter, agricultural buildings are typically plagued with inconsistent air temperatures throughout the buildings and cold air drafts which may be detrimental to poultry and animals. Further still, the ceilings, walls and floors of agricultural buildings in the winter are often damp with moisture or condensation.

In the past, agriculturists have used integrated systems of variable speed exhaust fans, suitably controlled by thermostatically controlled speed modulators, together with air intakes. Air intakes react to the withdrawal of air within the building by exhaust fans as well as the static pressure changes associated with enclosed buildings as they let fresh air into the buildings. Such systems may use high velocity air exchange and circulation for cooling in the summer and gentle, draft-free air exchange and movement during the winter months.

It is desirable to have an air intake that adjustably controls the volume, velocity and direction of fresh air drawn into the building which will blend and mix fresh air and building air to cool poultry and livestock, keep ceilings, walls and floors moisture free, keep the buildings smelling fresh and ammonia free, and will promote a consistent air temperature throughout the building from floor to ceiling.

SUMMARY OF THE INVENTION

An all season, adjustable fresh air intake for agricultural buildings is claimed which is adapted to adjust the volume, velocity and direction of fresh air drawn from the outside, through the intake and into the building suitably by exhaust fans. The intake is firstly comprised of a hollow building body. The body extends from outside the building, through a ceiling or wall of the building with an opening extending into the building for bringing fresh air into the building from the outside. An air intake housing with at least one opening is attachable to the building body on the inside of the building at the body opening through which fresh air from outside may flow. A pair of independently adjustable deflectors are pivotally mounted onto the housing adjacent the opening in opposing relationship to each other to manually open and close the opening as well as direct the fresh air from ceiling to floor as the fresh air if drawn into the building through the fresh air intake.

A principal object and advantage of the present invention is that it adjustably controls the volume, velocity and direction of fresh air drawn into the building, perhaps by an exhaust fan, from the outside through the invention.

Another object of the present invention is that its use for poultry and livestock buildings prevents heat stress, maintains production levels and controls flying insects during the summer while keeping the ceiling, walls and floors moisture free, with consistent air temperature throughout and smelling free of ammonia during the winter months.

Another object of the present invention is that it is simple to install and inexpensive to manufacture.

DETAILED DESCRIPTION

Figure 1:
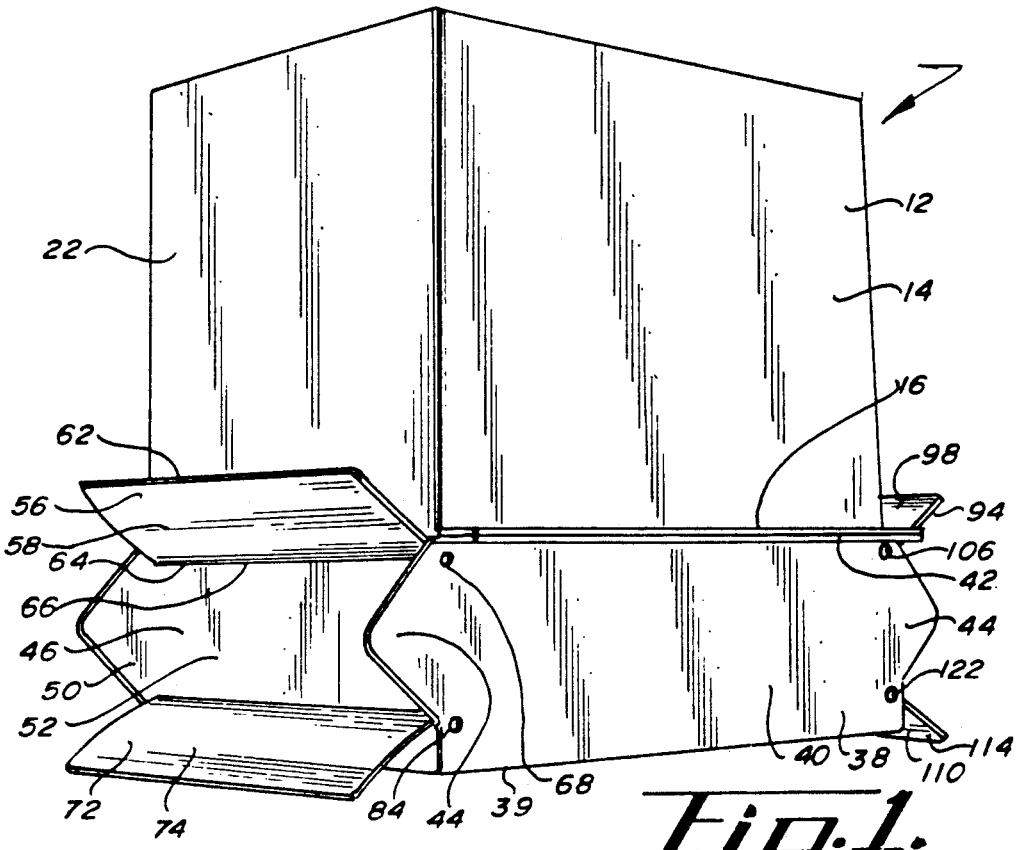
FIG. 1 is a perspective view of the fresh air intake of the present invention.

Referring to FIGS. 1–7, the all season adjustable fresh air intake 10 generally includes its attic body 12, which fits through the wall or ceiling of a building, connected to the air intake housing or frame 38 which is visible on the inside of the building. The intake housing 38 has a left opening 52 with a top adjustable deflector 56 and a bottom adjustable deflector 72 which will open and close the left opening 52 as well as direct the fresh air from the ceiling to the floor which is drawn into the building through the fresh intake 10. Intake housing 38 also has right opening 90 which similarly has top adjustable deflector 94 and bottom adjustable deflector 110 pivotally mounted thereat.

More specifically, building or attic body 12 is suitably hollow and made of galvanized sheet metal. Body 12 has a front wall 14 with a mounting lip 16, back wall 18 with a mounting lip 20, left side wall 22 and right side wall 24. The top of body 12 has a ceiling 26 (FIG. 6) with an opening top 28 therein from which hangs automatic dampers 30 held thereat suitably by plastic hinges 32. Automatic dampers 30 close upon fix air stop 34 by gravitational force. The bottom of building body 12 has opening 36 thereat.

Air intake housing or frame 38 has a bottom wall 39, a front wall 40 with a mounting lip 42 and protruding, pointed or triangular ends 44. Intake housing 38 also has back wall 46 with a mounting lip 48 and protruding or pointed or triangular ends 50.

Air intake housing 38 has a left opening 52 which is preferably rectangular. The left openings top edge 54 is located at the bottom of the left side wall 22 of attic or building body 12 after the attic body mounting lips 16 and 20 are suitably matched and connected such as by rivets to mounting lips 42 and 48 of intake housing 39. Top adjustable deflector 56 preferably has a convex inner surface 58, a concave outer surface 60, an outer edge 62 and an inner edge 64 with a pivot mounting rib 66 located therealong. Pivot mounting connectors or screws 68 appropriately may be self-tapping and pass through front and back walls 40 and 46 and into the ends of mounting rib 66, as shown, to permit the top adjustable deflector 56 to pivot and partially open and close left opening 52.

Left opening 52 also has a bottom edge 70 whereat bottom adjustable deflector 72 is located as it opposes top adjustable deflector 56. Bottom deflector 72 suitably has a convex inner surface 74, a concave outer surface 76, an outer edge 78, and an inner edge 80 with a pivot mounting rib 82 suitably therealong. Bottom adjustable deflector 72 is appropriately pivotally mounted to intake housing 38 by way of pivot mounting connectors or screws 84 passing through housing 38 and into mounting rib 82 as shown.

By this arrangement, outer edges 62 and 78 of top deflector 56 and bottom deflector 72 may be manually brought together as they pivot about ribs 66 and 82 to effectively close left opening 52 with the assistance of the triangular ends 44 and 50 of front wall 40 and back wall 46, respectively.

Air intake housing 38 also preferably has a right opening 90 preferably rectangular in shape having a top edge 92 formed by the bottom of the right side wall 24 of the building body 12. Along right opening 90 at top edge 92, top adjustable deflector 94 is located having a convex inner surface 96, a concave outer surface 98, an outer edge 100 and an inner edge 102 having a pivot mounting rib 104 therealong. Pivot mounting connectors or screws 106, which may be self tapping, appropriately passed through the front and back walls 40 and 46 of intake housing 39 and passed into the ends of mounting rib 104 to pivotally mount top adjustable deflector 94 thereat.

Right opening 90 also has a bottom edge 108 whereat bottom adjustable deflector 110 is located in opposing arrangement with top adjustable deflector 94 for right opening 90. Bottom deflector 110 suitably has a convex inner surface 112, a concave outer surface 114, an outer edge 116, and an inner edge 118 appropriately with a pivot mounting rib 120 therealong. As mentioned, pivot mounting connectors or screws 122 may pass through front and back walls 40 and 46 of intake housing 38 for mounting bottom deflector 110 in a cooperative and opposing relationship with top deflector 94 to effectively open and close right opening 90.

Figure 2:
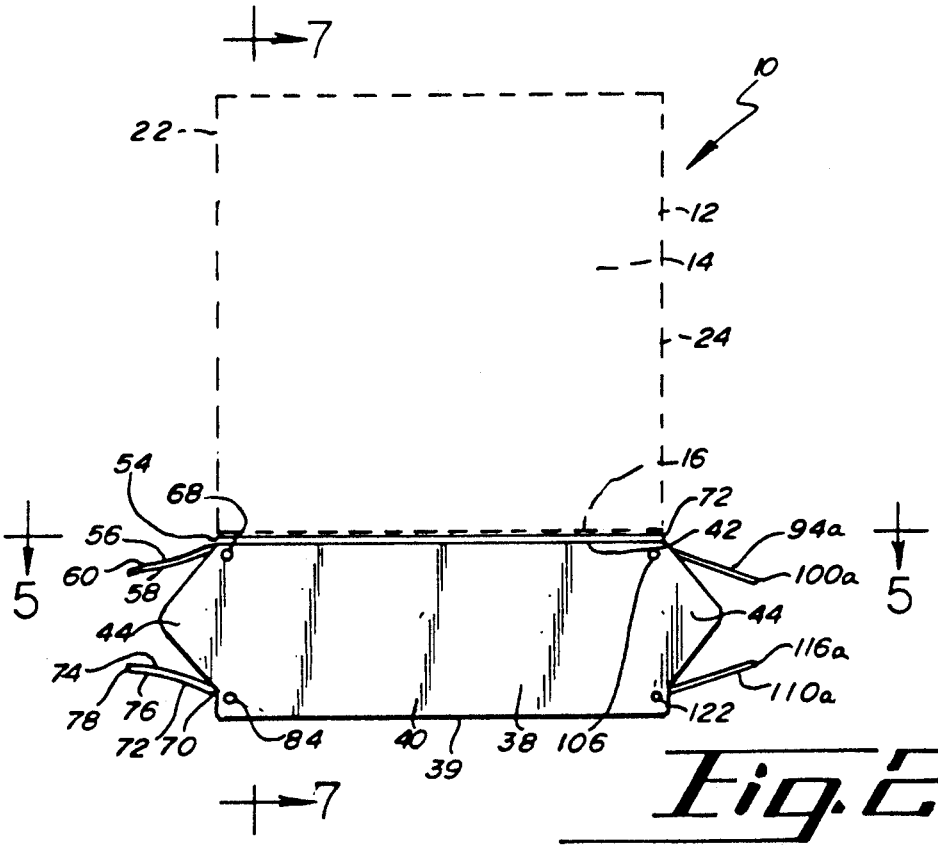
FIG. 2 is a front elevational view of the present invention with the backside being a mirror image and the attic body being shown in broken out line.
Figure 3:
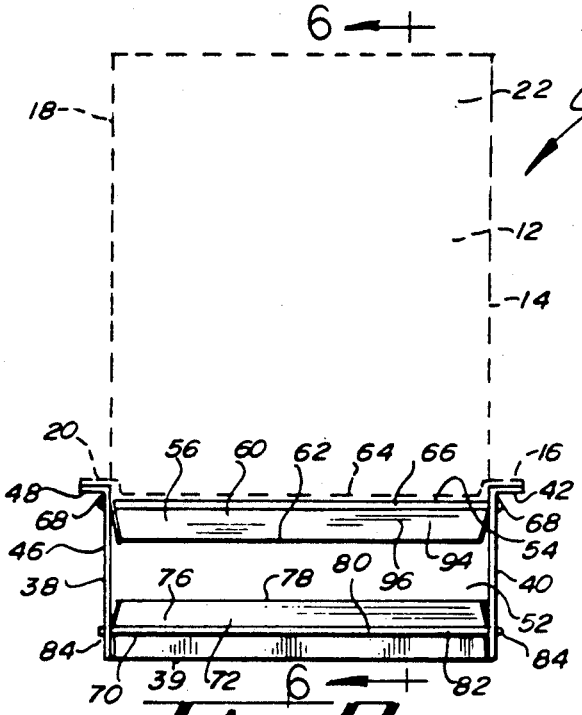
FIG. 3 is a side elevational view of the present invention with the other side being a mirror image and the attic body being shown in broken out line.
Figure 8:
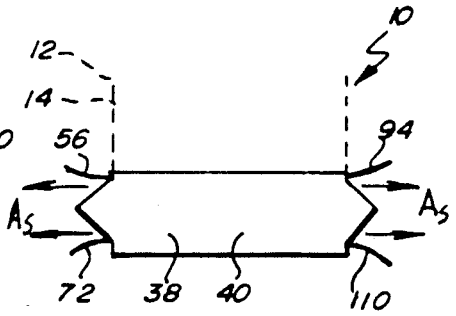
FIG. 8 is an elevational view of the present invention with the deflectors set for summer.
Figure 9:
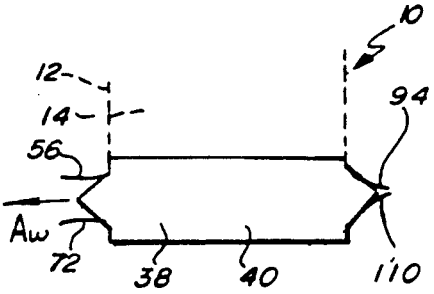
FIG. 9 is an elevational view of the present invention with the air deflectors set for winter.
Figure 6:
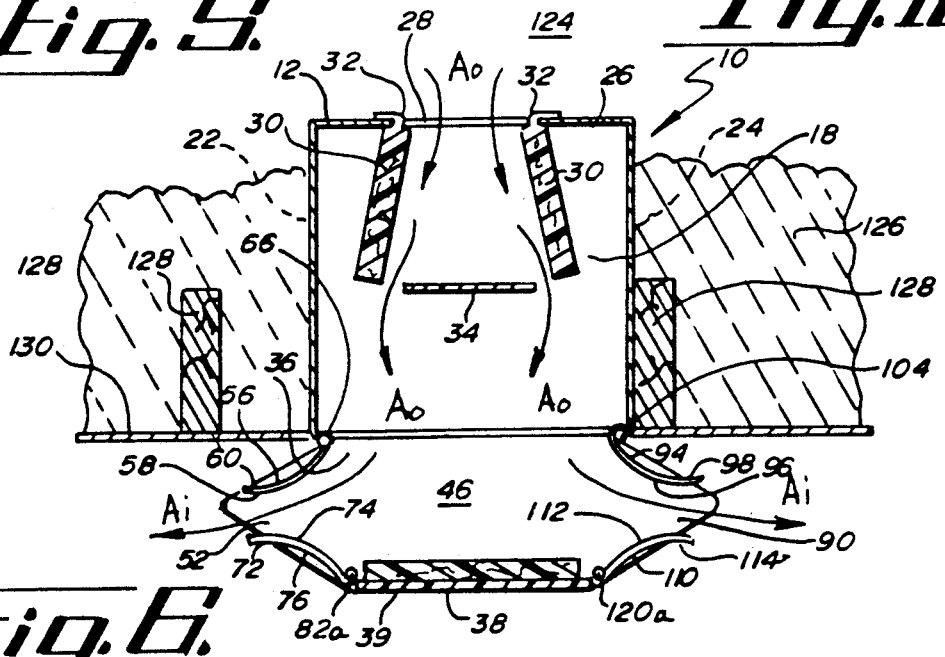
FIG. 6 is a cross-sectional elevational view of the present invention such as taken along lines 6—6 of FIG. 3 once installed and operating mounted in the ceiling of a building.
Figure 7:
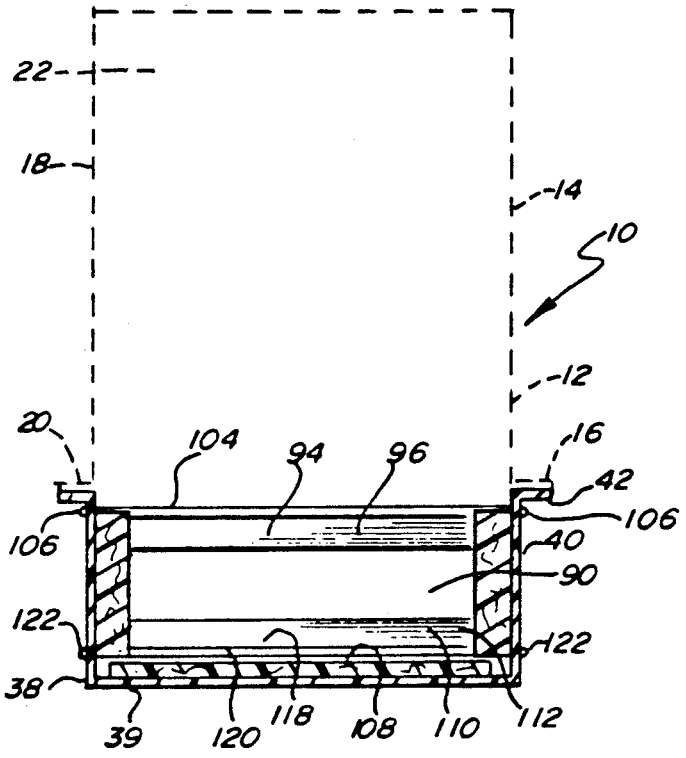
FIG. 7 is a cross-sectional elevational view of the present invention taken along lines 7—7 of FIG. 2 with attic body shown in broken out line.
Figure 12:
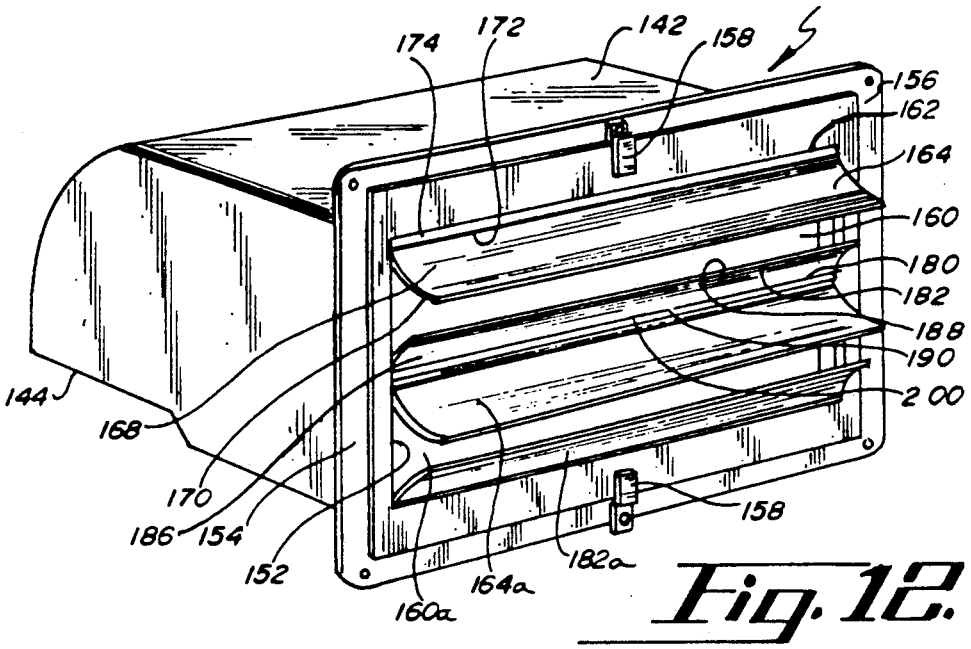
FIG. 12 is a perspective view of another embodiment of the present invention.
Figure 14:
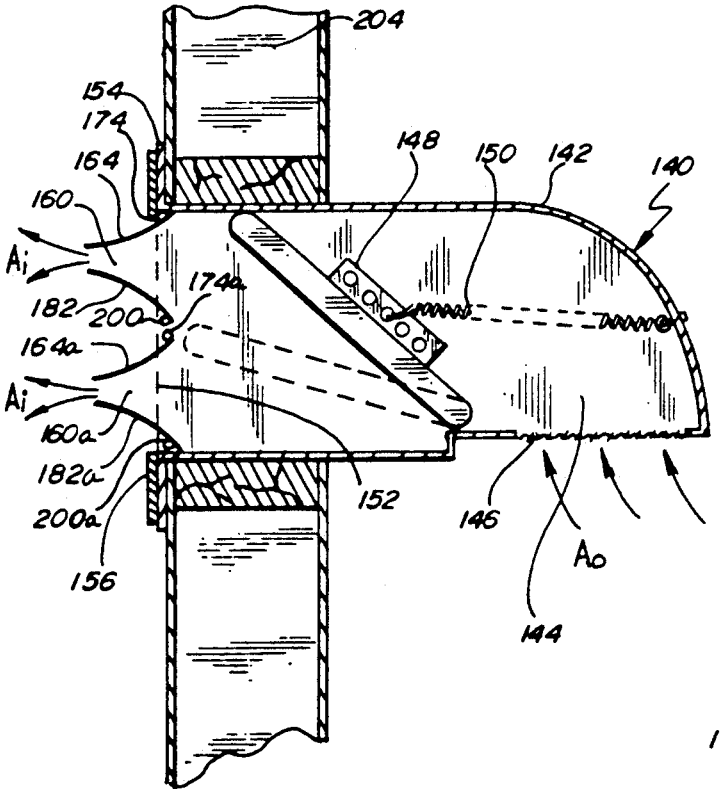
FIG. 14 is a cross-sectional elevational view of the other embodiment of the present invention installed and operating in the wall of a building.
Figure 15:
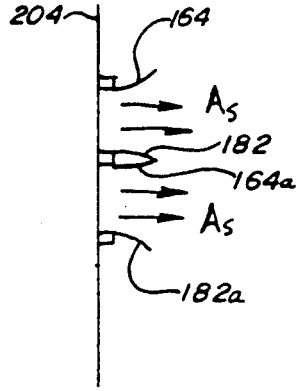
FIG. 15 is an elevational view of the other embodiment with the deflectors set for summer.
Figure 16:
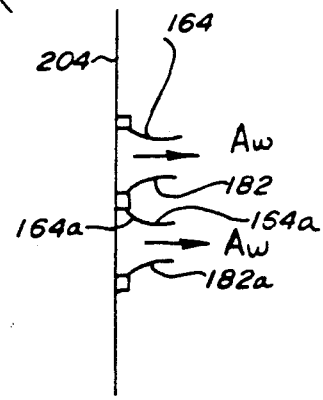
FIG. 16 is an elevational view of the other embodiment with the deflectors set for winter.

Referring specifically to FIG. 6, pivot mounting ribs 66, 82, 104 and 120 may exactly be at inner edges 64, 80, 102 or 118, or may be located closely thereto along outer concave surfaces 76 and 98 or located closely thereto along inner convex surfaces 74 and 112. As shown in FIG. 2, deflectors 56 and 72 are preferably curved. However, deflectors may be straight or planar as deflectors 94*a* and 110*a* are shown.

Air intake housing 38 as well as deflectors 56, 72, 94 and 110 are appropriately made of plastic, such as polyvinylchloride or other such suitably plastics such as polyethylene or other high impact plastics which readily lend themselves to thermo-forming. Such plastic materials are appropriate in that they do not rust in conditions of poultry or animal barns where humidity may be high.

Again, referring to FIG. 6, the mounting and general operation may be viewed. The attic 124 of the building constitutes the fresh air plenum for fresh air intake 10. Insulation 126 is generally present along with joists 128 above ceiling 130. Attic body 12 appropriately passes through ceiling 130 and insulation 126 between joist 128 and is open to the fresh air plenum or attic 124. After mounting lips 16 and 20 of attic body 12 are affixed to mounting lips 42 and 48 of intake housing 38, lips 16, 20, 42 and 48 suitably may be affixed to ceiling 130 by way of screws being drilled therethrough and preferably into joists 128 to securely hold attic body 12 and air intake housing 38 in place.

The general operation of fresh intake 10 may now be appreciated. Fresh attic air from outside the building (arrow $A_o$) may be drawn into the building by way of exhaust fans or static pressure changes which will move automatic dampers 30 away from fixed air stop 34 and permit outside air (arrow $A_o$) to pass into air intake housing 38 and out left and right openings 52 and 90. It can be appreciated that deflectors 56 and 72 as well as 94 and 110 cooperatively work together to manually open and close left and right openings 52 and 90 to adjustably control the volume and velocity as well as the direction of fresh air into the building (arrow $A_i$). Velocity of incoming air is increased by closing down deflectors 56 and 72 or 94 and 110. The resistance of ribs 66, 82, 104 and 120 held against housing walls 40 and 46 by screws 68 and 84 effectively holds the deflectors 56, 72, 94 and 110 in place after they are manually set.

Figure 11:
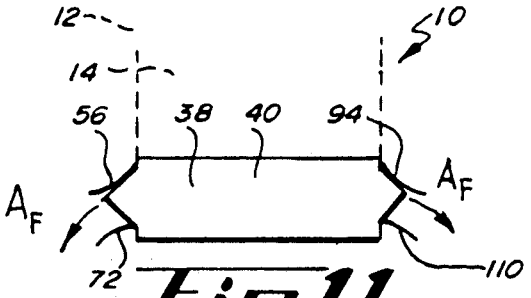
FIG. 11 is an elevational view of the present invention with the deflectors set for directing air flow to the floor.
Figure 10:
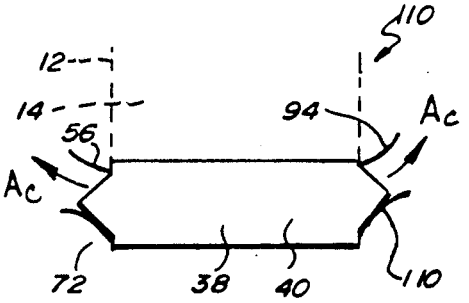
FIG. 10 is an elevational view of the present invention with the air deflectors set for directing air flow to the ceiling.
Figure 13:
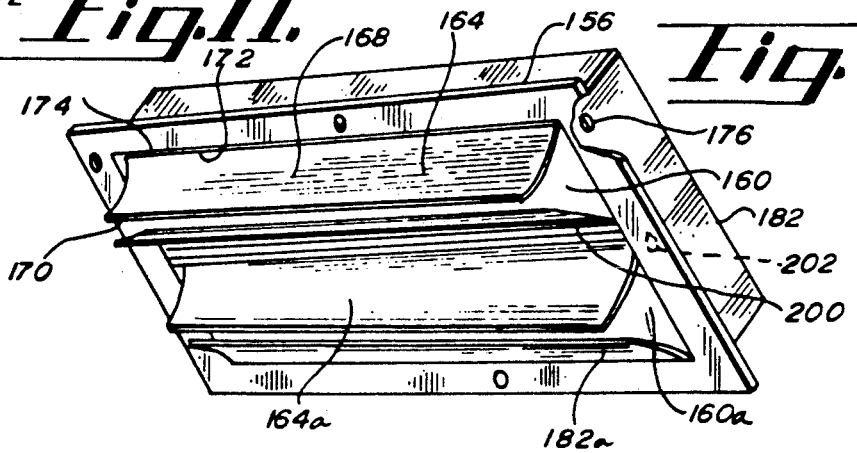
FIG. 13 is another perspective view of the other embodiment of the present invention.
Figure 4:
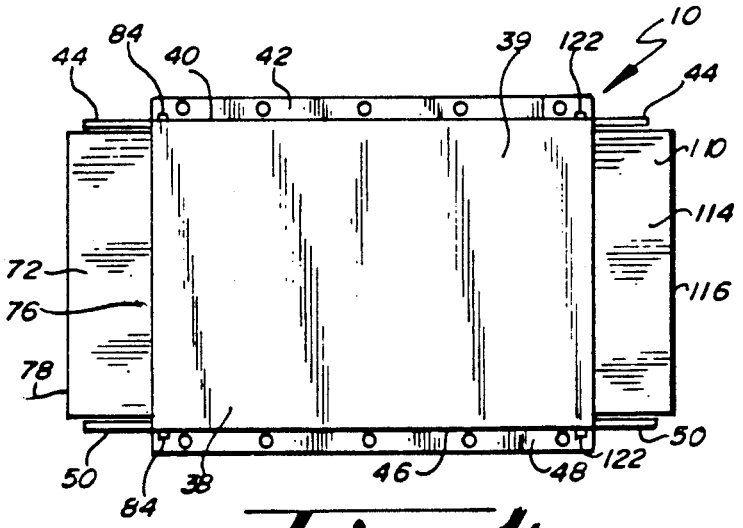
FIG. 4 is a bottom view of the present invention.
Figure 17:
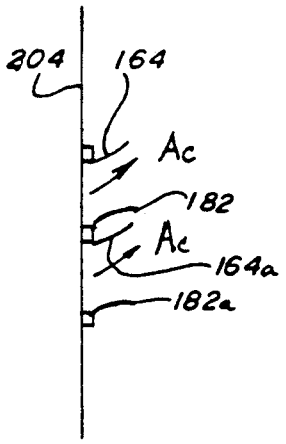
FIG. 17 is an elevational view of the other embodiment with the deflectors set to direct air to the ceiling.
Figure 5:
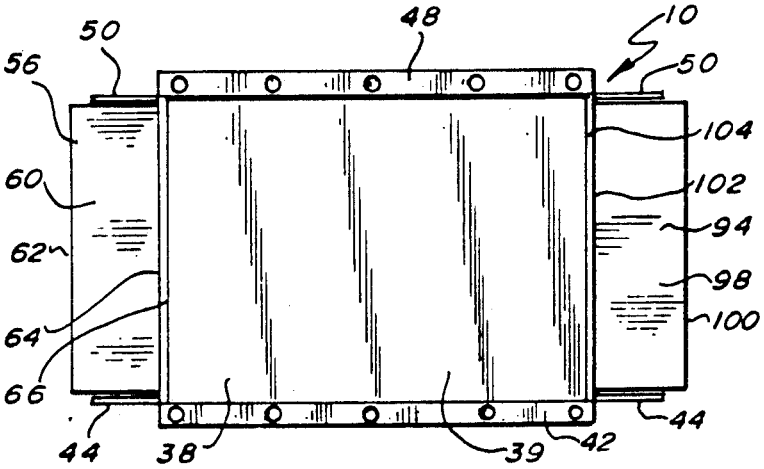
FIG. 5 is a top plan view of the present invention taken along lines 5—5 of FIG. 2.
Figure 18:
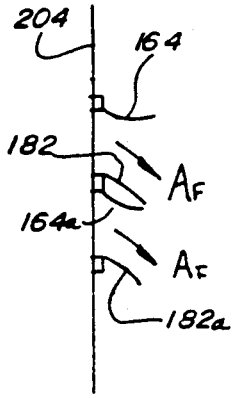
FIG. 18 is an elevational view of the second embodiment with the deflectors set to direct air to the floor.

Referring to FIGS. 8–11, the detailed operation of fresh intake 10 and the setting of the deflectors 56, 72, 94 and 110 may be further understood and appreciated. In the summer, deflectors 56, 72, 94 and 110 may be wide open to permit air to be drawn into the building through openings 52 and 90 without deflection or resistance of the deflectors (arrow $A_s$ in FIG. 8). In the winter, deflectors 56, 72, 94 and 110 may be completely closed or closed down which will increase the velocity of the cold winter air and render it more susceptible to the directional settings of the deflectors (arrow $A_w$ in FIG. 9). As seen in FIGS. 10 and 11, deflectors 56, 72, 94 and 110 may be directed upwardly or downwardly or anywhere in between to effectively control the direction of air flow from the ceiling (arrow $A_c$) to the floor (arrow $A_f$). It can now be appreciated that deflectors 56, 72, 94 and 110 have a convex inner surface 58 to increase their performance and eliminate abrupt changes in air direction to allow for smooth uninterrupted air flow thereacross virtually eliminating air turbulence and greatly reducing resistance as the air passes through fresh air intake 10.

Generally referring to FIGS. 12–18, another or a second embodiment of the present invention may be seen. Wall mount fresh air intake 140 suitably has a building or wall body 142 passing through the building that is hollow. Air intake housing or frame 156 fits into wall body 142 at the inside the building and appropriately has top opening 160 with top and bottom adjustable deflectors 164 and 182 as well as a bottom opening **160*a* with top and bottom adjustable deflectors 164*a* and 182*a***.

More specifically, wall mount fresh air intake 140 includes a building or wall body 142 which appropriately may be made of fiberglass or galvanized sheet metal as it is hollow. Wall body 142 has a downwardly outside opening 144 suitably with a bird screen 146 thereacross and has a biased damper 148 connected to a spring 150 therein.

Wall body 142 appropriately has a front opening 152 which is flush when mounted with interior wall 204 with a mounting lip 154 thereat for affixing wall body 142 to wall 204. Wall mount air intake housing or frame 156 is suitably held to front opening 152 at mounting lip 154 by way of frame latches 158.

Air intake housing or frame 156 appropriately has a top opening 160 with a top edge 162 whereat top adjustable deflector 164 is located. Deflector 164 has a convex inner surface 166, a concave outer surface 168, and an outer edge 170 and an inner edge 172 with a pivot mounting rib 174 therealong. Pivot mounting connectors or screws 176 appropriately pass through housing 156 and into the ends of mounting rib 174 for pivotal mounting of deflector 164.

Intake housing or frame 156 also has a bottom edge 180 along top opening 160 whereat bottom adjustable deflector 182 is located. Deflector 182 also suitably has a convex inner surface 184, a concave outer surface 186, an outer edge 188, and an inner edge 190 whereat pivotal mounting rib 200 is located. Similarly, pivot mounting connectors or screws 202 pass through intake housing 156 and into the ends of mounting rib 200 to adjustably affix bottom deflector 182 to housing or frame 156.

The preferred arrangement of wall mount fresh air intake 140 appropriately also has a bottom opening **160*a* along with all of the corresponding parts associated with top opening !60 and indicated in the drawings by "a" following the referenced numeral. The parts for both the top and bottom opening 160 and 160*a*** are the same.

Referring to FIGS. 15–18, the operation of wall mount fresh air intake 140 may be seen and appreciated. In the summer, deflectors 164, 182, **164*a* and 182*a* are appropriately opened all the way to permit the free flow of summer air into the building (arrow $A_s$ in FIG. 15). In the winter, deflectors 164, 182, 164*a* and 182*a* may be closed to restrict the air flow and increase the directional velocity of the cool winter air to avoid cold air drafts along the floor (arrow $A_w$ in FIG. 16). The deflectors 164, 182, 164*a* and 182*a* may be directed in a range from upwardly to the ceiling all the way down to the floor for controlled direction of air flow (arrows $A_c$ and $A_f$ of FIGS. 17 and 18**, respectively).

The present invention may be embodied in other specific forms without departing from the spirit or essential attributes thereof; and it is therefore desired that the present embodiment be considered in all respects as illustrative and not restrictive, reference being made to the appended claims rather than to the foregoing description to indicate the scope of the invention.

What is claimed is:

1. An all season adjustable air intake for an agriculture building with a ceiling and a floor adapted to adjust the volume, velocity and direction of fresh air which is drawn from outside through the intake and into the building, comprising:

(a) a hollow building body extending through the building with an opening directed into the building for bringing fresh air into the building from the outside;

(b) an air intake housing attachable to the building body on the inside of the building at the body opening having an air intake housing opening into the building with opposing edges at the air intake housing opening through which fresh air from outside, through the body, may flow; and (c) a pair of adjustable deflectors independent of each other wherein each deflector has an inner edge which is pivotally mounted onto the air intake housing at one edge of the air intake housing opening and opposing each other, both deflectors to move outwardly over a wide range directed from the ceiling to the floor to open and close the opening as well as to control the air volume, velocity and to direct the fresh air from ceiling to floor which is drawn into the building through the intake.

2. The all season adjustable air intake device of claim 1, wherein the deflectors are contoured each having a convex inner surface facing the opening.

3. The all season adjustable air intake device of claim 1, wherein the deflectors have an inner surface and an outer surface.

4. The all season adjustable air intake device of claim 3, wherein the deflectors have a pivot mounting rib on the outer surface adjacent the inner edge.

5. The all season adjustable air intake device of claim 3, wherein the deflectors have a pivot mounting rib on the inner surface adjacent the inner edge.

6. The all season adjustable air intake device of claim 1, wherein the deflectors have an inner edge with a pivot mounting rib thereat and adjacent the opening.

7. The all season adjustable air intake device of claim 6, further comprising two pair of screws, each screw being for passing through the housing into an end of the rib of one of the deflectors for pivotal mounting of the deflectors.

8. The all season adjustable air intake device of claim 1, further comprising a second opening in the intake housing and a second pair of adjustable deflectors pivotally mounted onto the housing adjacent the opening and opposing each other.

9. The all season adjustable air intake device of claim 8, wherein the openings oppose each other facing opposite directions within the building.

10. The all season adjustable air intake device of claim 8, wherein the openings face the same direction within the building.

11. The all season adjustable air intake device of claim 8, wherein the housing and the deflectors are made of thermo-formed plastic.

12. An all season, adjustable fresh air intake for agricultural buildings adapted to adjust the volume, velocity and direction of fresh air which is drawn from the outside through a ceiling opening in the building, comprising:

(a) an intake housing comprised of interconnected front, back and bottom walls with two open sides each having opposing edges at the open sides, the housing being adapted to be mounted over the building opening; and (b) two pairs of adjustable deflectors each with an inner edge, each pair comprising one top and one bottom deflector for each open side wherein the two bottom deflectors of each side are pivotally mounted at their inner edges between the front and back walls along the bottom wall at their respective open side edges and the two top deflectors of each side are pivotally mounted at their inner edges between the front and back walls along the other opposing side edges above and opposing their respective bottom deflectors, the deflectors being adjustably independent of each other to both outwardly move over a wide range to open and close the open sides and to adjust and control the volume, velocity and direction of the fresh air drawn into the building through the fresh air intake.

13. The all season, adjustable fresh air intake device of claim 12, wherein the deflectors have an inner surface and an outer surface.

14. The all season, adjustable fresh air intake device of claim 13, wherein the deflectors have a pivot mounting rib on the outer surface adjacent the inner edge.

15. The all season, adjustable fresh air intake device of claim 13, wherein the deflectors have a pivot mounting rib on the inner surface adjacent the inner edge.

16. The all season, adjustable fresh air intake device of claim 12, wherein the deflectors are contoured each having a convex inner surface facing their respective open side.

17. The all season, adjustable fresh air intake device of claim 9, wherein the deflectors have an inner edge with a pivot mounting rib adjacent the opening.

18. The all season, adjustable fresh air intake device of claim 9 further comprising connectors each adapted to pass through the housing into an end of the rib of one of the deflectors for pivotal mounting of the deflectors.

19. An all season adjustable air intake for adapted to adjust the volume, velocity and direction of fresh air which is drawn from outside through the intake and into the building, comprising:

(a) a hollow building body extending through the building with an opening extending into the building for bringing fresh air into the building from the outside;

an air intake housing attachable to the building body on the inside of the building at the body opening having a housing opening into the building with opposing edges through which fresh air from outside, through the body, may flow; and (c) a pair of adjustable deflectors independent of each other wherein each deflector is contoured having a convex inner surface facing the housing opening and an inner edge which is pivotally mounted onto the housing adjacent one edge of the housing opening and opposing each other to open and close the opening as well as to control the air volume, velocity and to direct the fresh air from ceiling to floor in a smooth uninterrupted fashion with minimal air turbulence as the air is drawn from the building through the intake.

* * * * *

UNITED STATES PATENT AND TRADEMARK OFFICE

CERTIFICATE OF CORRECTION

PATENT NO. : 5,088,388

DATED : February 18, 1992

INVENTOR(S) : Ronald E. Schaefer

It is certified that error appears in the above-identified patent and that said Letters Patent is hereby corrected as shown below:

Column 5, line 53, delete "!60" and insert --160--.

Column 6, line 11, chnage the word "agriculture" to --agricultural--.

Column 7, line 4, delete "agricultural buildings" and insert --an agricultural building with a ceiling and a floor--.

Column 7, line 29, after "range" insert --directed from the ceiling to the floor--.

Column 8, line 15, after the word "for" insert --an agriculture building with a ceiling and with a floor--.

Column 8, line 23, at the beginning of the line before the word "an" insert --(b)--.

Column 8, line 33, insert after "each other" the phrase --, both deflectors to move outwardly over a wide range directed from the ceiling to the floor--.

Signed and Sealed this

First Day of June, 1993

*Attest:*

Michael K. Kirk

MICHAEL K. KIRK

*Attesting Officer*

*Acting Commissioner of Patents and Trademarks*